US006636186B1

(12) United States Patent
Yamaguchi et al.

(10) Patent No.: US 6,636,186 B1
(45) Date of Patent: Oct. 21, 2003

(54) IMAGE DISPLAY MEDIUM, DEVICE AND METHOD

(75) Inventors: Yoshiro Yamaguchi, Kanagawa (JP); Kiyoshi Shigehiro, Kanagawa (JP); Motohiko Sakamaki, Kanagawa (JP); Shota Oba, Kanagawa (JP); Nobuyuki Nakayama, Kanagawa (JP); Kazunaga Horiuchi, Minamiashigara (JP); Takeshi Matsunaga, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 195 days.

(21) Appl. No.: 09/718,344

(22) Filed: Nov. 24, 2000

(30) Foreign Application Priority Data

Feb. 4, 2000 (JP) ..... 2000-028431

(51) Int. Cl.[7] ..... G09G 3/00; G09G 3/34; B41J 2/06; B41J 2/41

(52) U.S. Cl. ..... 345/31; 345/107; 345/55; 345/112; 347/55; 347/112

(58) Field of Search ..... 345/31, 107; 347/55, 347/112; 359/296; 204/643; 399/158

(56) References Cited

U.S. PATENT DOCUMENTS 3,756,693 A * 9/1973 Ota ..... 204/643
4,126,854 A * 11/1978 Sheridon ..... 345/107
6,106,104 A * 8/2000 Fujita et al. ..... 347/55
6,285,382 B1 * 9/2001 Wakahara et al. ..... 347/112
6,407,763 B1 * 6/2002 Yamaguchi et al. ..... 345/107

FOREIGN PATENT DOCUMENTS

JP 8-101409 4/1996

OTHER PUBLICATIONS

"New Toner Display Device (I)", Gugrae–Jo et al., Japan Hardcopy 99, pp. 249–252 (w/abstract).

* cited by examiner

*Primary Examiner*—Bipin Shalwala
*Assistant Examiner*—Prabodh Dharia
(74) *Attorney, Agent, or Firm*—Oliff & Berridge, PLC

(57) ABSTRACT

An image display medium provided with a pair of substrates both of which are substantially transparent, and a gas enclosed in space defined between them. Each of the pair of the substrates is provided with transparent electrodes (ITO). The space defined between the substrates encloses two types of particle groups having colors different from one another, have a negative charge polarity, and have different adhesiveness from each other with respect to the substrates. A white particle group having a positive polarity is further enclosed in the space. A voltage is applied to the electrodes 28 and 30 so as to apply an electric field determined in response to the types of particles to be transferred. Thus, a plurality of colors are selectively developed via the particle groups enclosed in the space for displaying different colors.

19 Claims, 12 Drawing Sheets

28
32
34M
34Y
30

28
32
34M
34Y
30

28
32
34Y
34M
30

28
32
34Y
34M
30

28
34Y
34M
32
30

28
34Y
34M
32
30

28
34M
34Y
32
30

28
34M
34Y
32
30

IMAGE DISPLAY MEDIUM, DEVICE AND METHOD

BACKGROUND OF THE INVENTION

1. Field of the Invention

The present invention relates to an image display medium, device, and method, and more particularly to an image display medium, device and method using movable particles.

2. Description of the Related Art

Conventionally, display technologies such as Twisting Ball Display (rotational display by particles colored separately into two colors), or using electrophoresis, magnetophoresis, thermal rewritable medium, liquid crystals having a memory function and the like have been proposed for a sheet-like image display medium which is repeatedly rewritable. Among the above described display technologies, although thermally rewritable mediums and liquid crystals having memory functions where excellent memory functions for images, display surface color cannot be made as that of white as white paper. Thus, it is difficult to visually discern confirm a distinctions between image parts and non-image parts when certain images are displayed, that is, there has been a problem of poor image quality. Other display technologies using electrophoresis or magnetophoresis are those which, and colored particles having are memory function for image dispersed in a white liquid. Thus, the display technologies using electrophoresis or magnetophoresis are excellent for displaying white colors. However, there has been a problem of poor image quality, since the white liquid enters between colored particles, resulting in black color image parts appearing grayish. Moreover, since white liquid is enclosed inside an image display medium, there is a possibility that the white liquid will leak from the image display medium, if the image display medium is removed from an image display unit and handled roughly, like a paper. Another technology, Twisting Ball Display has memory functions, uses oil. The oil exists substantially in a solid state only in cavities around particles inside an image display medium. Thus it is comparatively easy to construct the image display medium in the form of a sheet. However, even if each hemispherical surface of the particles has been coated in white and perfectly aligned at a side of the display, light entering between the spherical the particles is not reflected and lost inside the display. Thus, in principle, a white display having a coverage of 100% cannot be achieved, resulting in a slightly grayish appearance when the color should be white. Further, since particle size is required to be smaller than pixel size for obtaining high resolution, particles coated with different colors thereon must be made smaller. Hence an advanced manufacturing technique is required.

In order to solve the problems as described above, there has been proposed a similar display technology using toner. Colored conductive toner particles and white particles are enclosed between opposed electrode substrates. When the colored conductive toner particles are charged by contact with the electrode substrates, the charged colored toner particles move toward the substrate at the side of the display surface through non-charged white particles due to an electric field established between the electrode substrates. The colored toner particles are deposited on the inside of the substrate at the display surface side, whereby an image is displayed using difference in contrast between the colored toner particles and white particles. The present display technology is advantageous in that where a whole image display medium is composed of solid materials, the display can be switched between black and white colors with a coverage of 100% from each other, in principle. Furthermore, a technology for displaying a color image by using a laminated display medium in which colored particles forming a chain structure via a electric field are dispersed in an electrically insulating solvent has been disclosed in Japanese Patent Laid-Open No. 101409/1996. By using the technology described above, representing with three colors is possible, but leakage cannot be avoided as there is liquid enclosed in the display medium. In addition, if this technology is used, power must be constantly applied to the display medium for effecting light transmission, which results in poor memory function.

According to the display technology using toner particles, a displayed image can be stored without any power being applied. Moreover, the display medium is easily handled and manufactured, so that there are additional advantages relative to the technology using electrophoresis. However, an image is displayed with two colors by moving a single kind of charged colored particles via an electric field, and hence the image cannot, in principle be display with three or more colors in a single display cell.

Furthermore, in a display unit using toner particles, even when it is intended to use a technology displaying multiple colors in combination with laminated cells, which cells can represent colors different from each other, toner particles having different colors exist on the side of a substrate surface opposed to the display surface, therefore, it is difficult to display a color in a lower layer by transmission through an upper layer having another color. Generally, in a laminated-type display panel, since lamina of each layer is for each different color of the display, a sense of disorientation or vertigo can arise when multiple colors are displayed. Thus, as much as possible, it is preferred that such multiple colors be displayed on a single surface.

In another color display technology, cells each having a different color are arranged adjacent to each other. In this respect, however, there is an inverse relationship between the number of cells that can be combined into a single pixel, and the number of colors that can be displayed, resulting in a limited resolution. Accordingly, it is desirable to display as many colors as possible in a single cell.

SUMMARY OF THE INVENTION

The present invention has been made in view of the background described above, so that an object of the present invention is to provide an image display unit, an image display medium, and an image display controller, wherein a plurality of colors are allowed to develop selectively with groups of particles enclosed in a space defined between a pair of substrates.

In order to attain the above object, an image display medium comprises a pair of substrates, with one or more of the substrates being at least translucent or substantially transparent, and space defined between them with at least one of a gas disposed in the space, or a partial vacuum formed in the space; and a plurality of types of particle groups enclosed in the space defined between said pair of the substrates, each particle type having a charge of a polarity identical in polarity to all of the other types of particle groups, and the types of particle groups having an adhesiveness with respect to the substrates different from one another.

Preferably, at least one of the pair of the substrates is substantially transparent, with gas enclosed in the space defined between the pair of the substrates, or a partial vacuum formed in the space, or some combination thereof.

The plurality of types of particle groups are enclosed in the space defined between the pair of the substrates. The plurality types of particle groups have different colors from one another, with each type having a charge of a polarity identical to all of the other types of partical groups, and an adhesiveness with respect to the substrates which is allowed to differ from one another. An image display medium comprises the pair of the substrates and the plurality of types of particle groups.

An electric field generator is connected to the substrates for applying an electric field having an intensity according to the average charge amount of a type of particle group for transffering that type of particle group to one of the substrates for displaying a particular color.

In the meantime, the adhesiveness of the particle groups with respect to the substrates indicates the degree of difficulty in separating respective particles in the particle groups away from the substrates. In this connection, the adhesiveness of particle groups with respect to substrates is determined specifically by at least one factor of an average charge amount per particle, an average diameter of particles, an average degree of sphericity per particle, and an average degree of surface roughness per particle and taking such factors into consideration when an electric field is applied by the electric field generator. Namely, when particles adhere to substrates, van der Waals force (intermolecular force) functions between the substrates and the particles. This force corresponds to contact areas defined by particles in contact with the substrates. The larger the contact areas become, the more intensive the force becomes, and the adhesiveness (difficulty in separating particles) becomes greater. The contact area corresponds to a diameter of particle, average degree of sphericity per particle, and an average degree of surface roughness per particle. On the other hand, particles have been charged as mentioned above, and when an electric field is applied by an electric field generator to the particles, electric or Coulomb attraction acts upon the particles. The Coulomb attraction varies with an amount of charge on the particles.

It is to be noted that the average diameter of particles, average charge amount per particle, average degree of sphericity per particle, and average degree of surface roughness per particle are defined by, for example, the following measurements;

Average charge amount: Blowing off or adherence of an electric field to an insulation film Average diameter of particle: A value of 50% in volume measured by a particle counter Average degree of sphericity: Out-of-roundness in a projected image of a particle measured by a microscope Average surface roughness: (a peripheral length of a projected image of a particle measured by a microscope)/(a peripheral length of a circle having the same area as that of the projected image)

Furthermore, a diameter of a particle, a degree of sphericity of a particle, and surface roughness of a particle are specified by method of pulverization or a chemical technique. Namely, particles used in the present invention are prepared by usual methods for preparing fine particles as described in "Fine Particle Industry" edited by the Technical Association of Japan Powder Industry: Asakura Publishing Co., etc.

A first method is for mechanically preparing particles from a large bulk. The particles each has a desired particle diameter and surface condition by means of compression, mechanical shock, and shear crushing; pulverization of the particles by the use of roll mill, pin mill, and jet mill; classification of the particles by means of mechanical, and jetting method; and adjustment of a surface condition of the classified particles by means of a compounding device.

A second method is a method in which uniform, spherical individual particles or fine particle agglomerates are chemically prepared by means of emulsion polymerization and the like, and then the resulting materials are classified by sedimentation, centrifugal separation or the like.

Meanwhile, the present inventors have found that a display medium in which charged particles are used, exhibits the following characteristic features in the course of accomplishing the present invention. Namely, in the display medium in which charged particles are employed, adhesion of the particles to substrates and separation of the particles from the substrates can be rapidly effected as compared with a medium in which a solvent is used in electrophoresis. Since this type of a medium exhibits threshold characteristics with respect to an electric field strength, it can be precisely controlled by means of the intensity of electric field strength. More specifically, in the display medium using the particles, the particles adhere to and are immobile from the surface of substrates before the electric field reaches a certain level, but when it exceeds the level, the particles are separated from the substrates and can move to the opposing substrate at a high speed. This is because the particles are surrounded by a gas or in a substantial vacuum, so that it is considered that the particles which were once released from adhesion move easily to the opposed substrate. For this reason, when it is intended to release the particles, transfer of the particles can be accurately adjusted by controlling the electric field strength. Furthermore, adhesiveness of particles can be also desirably changed by selecting particle configuration or particle diameter in addition to the control of an amount of charge of the particles.

On the other hand, when an electrophoretic method is used, since an insulating solvent exists around particles, a moving speed of particles becomes extremely slow due to strong viscosity resistance, so that it is unsuitable for high-speed operation required in a display unit. Moreover, variations in adhesiveness of particles to the substrate when an electric field is not applied are large, so that no threshold value for particle movement can not be determined with respect to an electric field. Concerning memory function, when the solvent is oscillated, a large dynamic force is directly applied to particles, so that the particles are separated from or contact with each other due to uncontrollable environmental factors by a user.

Therefore, in a plurality of such particle groups enclosed in a gas or vacuum, having different colors, having the same polarity, and making adhesiveness to the substrate different from one another, the movement of the particle groups can be selectively and precisely adjusted by controlling an electric field strength, because of the reasons mentioned above. As a consequence, according to the present invention, a plurality of colors can be selectively developed to attain color display by means of particle groups enclosed in space defined between a pair of substrates.

Three or more types of particles having the same polarities can be enclosed in the space. According to convenience in developing color or other like reasons, such a particle group having substantially the same degree of electrostatic adhesiveness and a different color may further be added. In other words, a desired color is produced by the use of the particle group having substantially the same degree of electrostatic adhesiveness and a different color. In this case, when one particle group is moved, the particle group added further is simultaneously moved.

Moreover, a particle group having a different polarity of charge from that of the above described particle groups is enclosed in the space together with them, that is, at least one particle group having of a different polarity of charge from that of the plural types of particle groups enclosed in the space between the substrates. As a result, it becomes possible to display further richer colors. Particularly, when the at least one particle group has a white color (the above described plural types of particle groups do not contain white particle group in this case), it becomes possible to display an image having a high contrast as of a color image that was printed on a white paper. In this case, it may be arranged such that the at least one particle group can be a plurality of types of particle groups which have adhesiveness to substrates different from one another as in the aforementioned plural types of particle groups.

Furthermore, adhesiveness of each of the above described plural types of particle groups may be allowed to have a predetermined distribution breadth. According to such modification, it becomes possible to continuously change a density thereof. In this case, however, when the distribution breadth overlaps that of another type of particle group, it results in turbidity of color in the overlapping region. Accordingly, a portion of particles existing in such overlapped region is desirably, for example, 30% or less. The overlapped region is desirably in a cell, with overlapping as low as possible. The distribution breadth in electrostatic adhesiveness can be determined by suitably selecting a particle diameter distribution for particles to be used.

In the meantime, it may be arranged in such that a plurality of a pair of substrates enclosing the above described plural types of particle groups in space defined between them are disposed two-dimensionally. However, it may also be arranged in such that the above described space contains a first section space enclosing the plural types of particle groups, and a second small section space part adjacent to the first section space and enclosing at least one particle group having a different color from that of the plural types of particle groups. Even in the case where multiple colors are displayed by combining adjacent section spaces with each other, a display color displayed in the respective section spaces can be increased. Accordingly, the number of cells forming one picture element can be reduced. Into the second small space part, the above described plural particle groups maybe enclosed as in the first section space.

Moreover, an electric field generator applies an electric field having intensity corresponding to the particle types to be transferred or moved, after the plural types of particle groups are moved to one of substrates. According to this arrangement, it becomes possible to achieve control for selectively moving or transferring particles, whereby color image quality can be improved. Particularly, in the case where white particles are enclosed as a particle having a reverse polarity, and an electric field is applied such that the white particles shift to the side of the display screen, wherein the white particles have adhered previously to the side of display screen. Accordingly, when a color image is formed, there is no unevenness on the display surface, so that colors in the image appear brilliantly.

Furthermore, it may be arranged such that a memory for storing a present display color determined by at least one particle group transferred or moved to one of substrates having translucence is provided; and the electric field generator determines a manner for applying an electric field for displaying the following display color on the basis of the present display color stored in memory as well as the following color for display, and applies the electric field in accordance with the manner determined for applying the electric field. In case of displaying animation, it is more natural for a viewer that color change for each cell unlike the above described mode. Accordingly, the present mode is particularly effective for movies.

An image display medium according to the present invention described is provided with a pair of substrates at least one of which is substantially transparent, space defined between them containing a gas or substantial vacuum; and a plurality of types of particle groups enclosed in the space defined between the substrates in such a manner that they can be transferred between the substrates by means of an applied electric field, types of particle groups, which having charge properties that are the same as one another. As mentioned above, the above described van der Waals force (intermolecular force) acts between the substrates and the particles. Thus, it becomes possible to provide an image display medium having memory function, being easily handled, and capable for displaying multiple colors.

An image display controller is provided with a mounting assembly for detachably mounting the above-mentioned image display medium to the electric field generator, and the electric field generator for applying an electric field having an intensity in response to types of particle groups to be moved or transferred in the image display medium mounted to the mounting assembly. Hence, it is possible to store an image stored after the image display medium has been mounted, and then dismount and transport the medium to another location, wherein the image is maintained in the medium, due to its memory function.

Furthermore, it may be arranged in such that the above described electric field generator, applies the electric field in such a manner that particles collide with the substrate at a predetermined collision speeds less than that at a level which will cause particle deformation as a result of collisions with the opposing substrate. In this case, it may also be arranged such that the electric field generator applies a strong electric field required for initially pulling particles away from a substrate during an initial period, wherein the particles were initially adhered to the substrate.

DETAILED DESCRIPTION OF THE PREFERRED EMBODIMENTS

Figure 1:
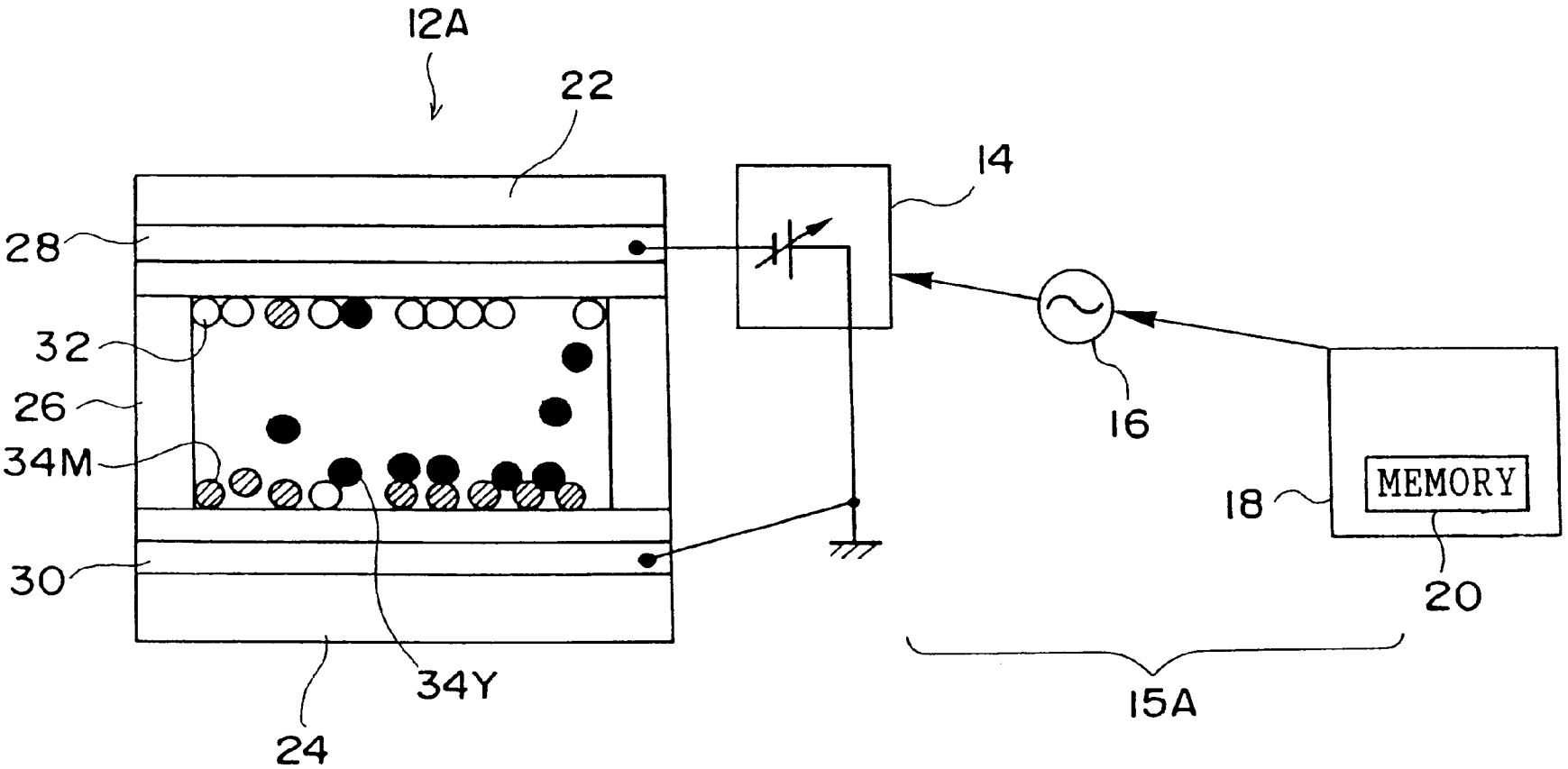
FIG. 1 is a schematic diagram showing a preferred embodiment of an image display unit according to the present invention.

Preferred embodiments according to the present invention will be described hereinafter by referring to the accompanying drawings. As shown in FIG. 1, a first preferred embodiment of an image display unit according to the present invention is provided with an image display medium 12A and an electric field generator 15A.

The image display medium 12A is provided with a pair of substrates 22 and 24 at least one of which (both of them in this embodiment) is substantially transparent and a gas enclosed in the space defined between them (or a substantial vacuum). Each of the pair of the substrates 22 and 24 is provided with substantially transparent electrodes (ITO) 28 and 30 hereinafter in the following description, referred to simply as "transparent" for convenience. More specifically, glass substrates each provided with the transparent electrodes 28 and 30 having a size, for example, 25×25×1.1 millimeters may be used as the substrates 22 and 24 for composing the image display medium 12A. A space is defined between the pair of the substrates 22 and 24 by a silicone rubber plate 26, the central portion of which has been bored into a square contour having a 15×15 millimeter size, as mentioned hereinafter.

In the above described space defined between the pair of the substrates 22 and 24, are enclosed a plurality of types of groups of particles 34M and 34Y (two groups in the first embodiment), which have different colors from one another, have the same charge polarity (negative in the present embodiment) relative to each other, and are adapted to have different adhesiveness with respect to the substrates 22 and 24. In the present first embodiment, there is at least one (one in the first embodiment) type of particle group 32 having a different charge polarity (positive in the first embodiment) from that of particle groups 34M and 34Y, enclosed in the above described space. It is to be noted that the particle group 32 is white. In this case, a plurality of types of particle groups, having adhesiveness of which are adapted to be different from one another with respect to the substrates 22 and 24 as described above, may be enclosed as particle types, all having a charge polarity from the particle groups 34M and 34Y.

The electric field generator 15A is provided with an AC power source 16. A TREK amplifier 14 for amplifying a voltage generated from the AC power source 16 is connected between the AC power source 16 and the transparent electrodes 28, 30 wherein a side of the transparent electrode 30 is grounded. Furthermore, the AC power source 16 is provided with a memory 20, and to which is connected a controller 18 containing a CPU, ROM, RM, I/O port and the like (all of them are not shown) being in a connectable arrangement with each other.

An example of white particles for the particle group 32, includes spherical fine particles of crosslinked polymethyl methacrylate containing titanium oxide ("MBX-White" manufactured by Sekisui Plastics Co., Ltd.), spherical fine particles of crosslinked polymethyl methacrylate ("Chemisnow MX" manufactured by Sohken Kagaku), fine particles of polytetrafluoroethylene ("Lubron L" manufactured by Daikin Industries, Ltd., "SST-2" manufactured by Shamrock Technologies Inc.); fine particles of carbon fluoride ("CF-100" manufactured by Nippon Carbon Co., Ltd., "CFGL", "CFGM" manufactured by Daikin Kogyo); silicone resin fine particles ("Tosspearl" manufactured by Toshiba Silicone K.K.); fine particles of polyester containing titanium oxide ("Biryushea PL 1000 White T" manufactured by Nippon Paint Co., Ltd.); polyester-acrylic fine particles containing titanium oxide ("Konac No. 1800 White" manufactured by NOF CORPORATION); spherical fine particles of silica ("Hipresica" manufactured by UBE-NITTO KASEI Co., Ltd.), and the like.

The particle group 34M was prepared by preparing particles of magenta color in accordance with the following procedure. Namely, 100 parts by weight of polyester resin, 4 parts by weight of C.I. Pigment Red 57, and 110 parts by weight of ethyl acetate were dispersed by a ball mill for 48 hours to obtain a liquid C. Additionally, 100 parts by weight of 2% aqueous carboxymethylcellulose was prepared to obtain a liquid D. Then, 100 parts by weight of the liquid D was agitated by an emulsifier, and to the resulting emulsion was introduced, slowly, 50 parts by weight of the liquid C to suspend the mixed liquid. Thereafter, ethyl acetate was removed under reduced pressure, rinsed, dried, and classified to obtain particles of magenta color 19M, an average particle diameter of which was made to be 12 $\mu$m.

Yellow particles were prepared for forming the particle group 34Y in accordance with the following procedure. Namely, 100 parts by weight of polyester resin, 5 parts by weight of C.I. Pigment Yellow 12, and 110 parts by weight of ethyl acetate were dispersed by a ball mill for 48 hours to obtain a liquid E. Further, 100 parts by weight of 2% aqueous carboxymethylcellulose was prepared to obtain a liquid F. Then, 100 parts by weight of the liquid F was agitated by an emulsifier, and to the resulting emulsion was introduced, slowly, 50 parts by weight of the liquid E to suspend the mixed liquid. Thereafter, ethyl acetate was removed under reduced pressure, rinsed, dried, and classified to obtain particles of yellow color, an average particle diameter of which was made to be 10 $\mu$m.

In order to control the charge of the particle groups 34M and 34Y, an additive STT-100 was added to the composition for each particle group. In this case, an amount to be added was 0.1% by weight with respect to the particle group 34M thereby making its charged amount to be $-8\times10^{-15}$C, while an amount to be added was 0.4% by weight with respect to the particle group 34Y thereby making its charge amount to be $-16\times10^{-15}$C.

Adhesiveness of particles with respect to the substrates 22 and 24, may be arranged to have a distribution breadth for particles of the same type, which does not overlap that of particles of other types. Furthermore, particles of a plurality of colors may be contained in particle groups, having the same adhesiveness.

Figure 2:
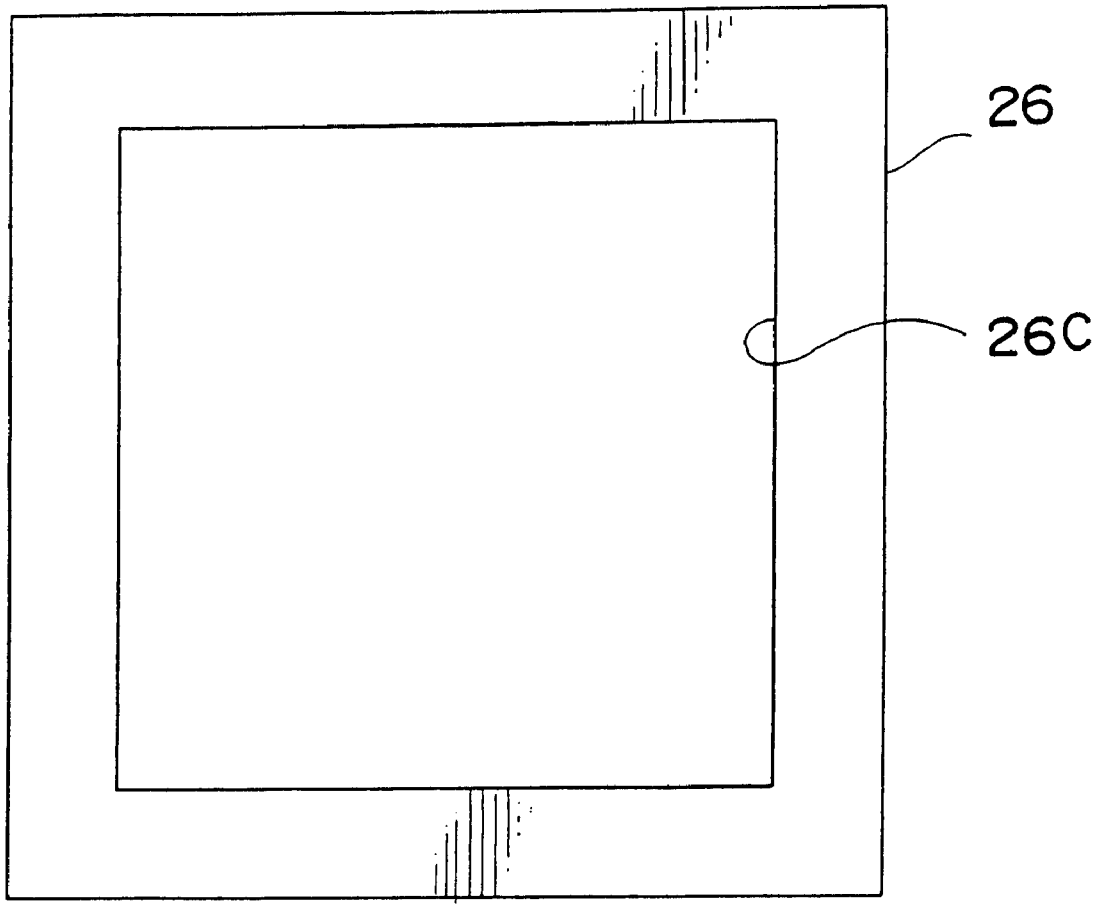
FIG. 2 is a front view showing a silicone rubber plate for defining space between a pair of substrates in the image display unit.
Figure 3:
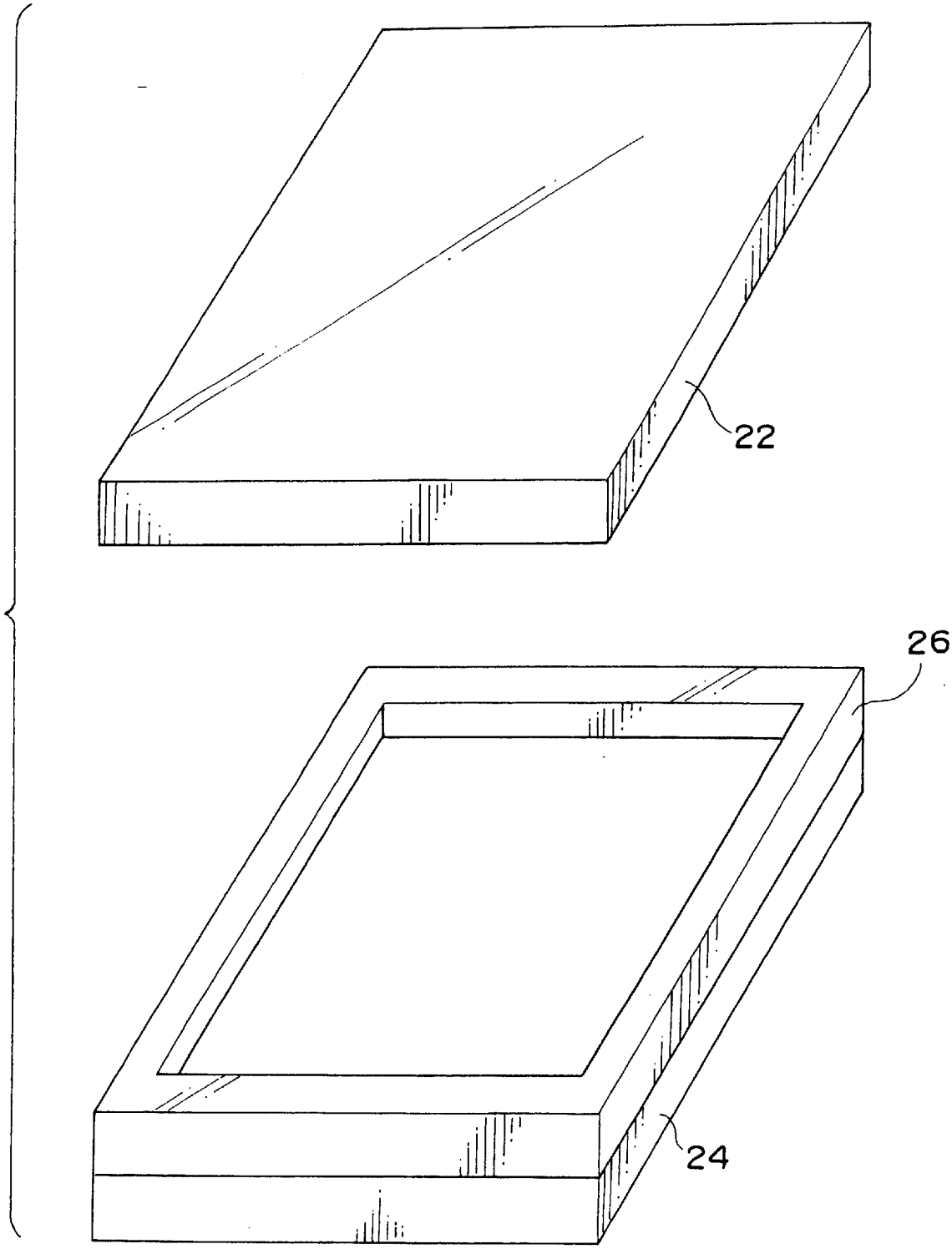
FIG. 3 is an explanatory view for explaining a method for preparing a preferred embodiment of an image display medium according to the present invention.

A process for preparing the above described image display medium 12A will be explained as follows. The silicone rubber plate 26, the central part 26C of which was cut out into a square contour having a 15×15 millimeter size to define a space as shown in FIG. 2, is disposed on the substrate 24 as shown in FIG. 3. Spherical white insulating particles 19W having a 20 μm average particle diameter (a classified product of "Techpolymer MBX-20-W" manufactured by Sekisui Plastics Co., Ltd.), the magenta color particles 19M, and the yellow color particles 19Y are mixed with each other in a ratio of 1:2:2, and about 20 milligrams of the resulting mixed particles are allowed to passthrough a screen, into the space cut out into the square contour in the silicone rubber plate. Thereafter, the first substrate 121 is allowed to be in close contact with the silicone rubber plate, and both the first and second substrates are held forcibly by means of an alligator clip to thereby bond the silicone rubber plate, and the first and the second substrates to each other to form the image display medium 12.

Next, a mechanism of transferring particles for displaying an image will be described hereinafter by referring to FIGS. 4A to 4H.

First, it is to be noted that the charge condition in the case when three types of the particles in the present embodiment are mixed, is in such that the yellow particles 34Y are charged strongly negative, the magenta particles 34M are charged weakly negative, and the white particles 32 are charged positive, as mentioned before.

The particles which have been mixed and charged are moved by means of an electric field. Accordingly, when an electric field is applied to the space defined between the substrates, the particles move to each electrode having a polarity opposite to their own charged polarity (see FIG. 4A). More specifically, when a strongly positive electric field is applied to the electrodes 28 and 30 such that the side of the electrode 30 becomes positive, and the side of the electrode 28 becomes negative, the white particles move to a negative area (the side of the electrode 28), while the yellow particles 34Y and the magenta particles 34M move to a positive area (the side of the electrode 30), and it results in a red display (see FIG. 4A). In this case, the display surface (the side of the electrode 30) is positive. In this situation, even when the electric field is thereafter reduced zero, the particles do not significantly shift due to adhesiveness with the electrode, so that the above described displayed state is maintained (see FIG. 4B).

Figures 4A, 4B, 4C, 4D, 4E, 4F, 4G, 4H:
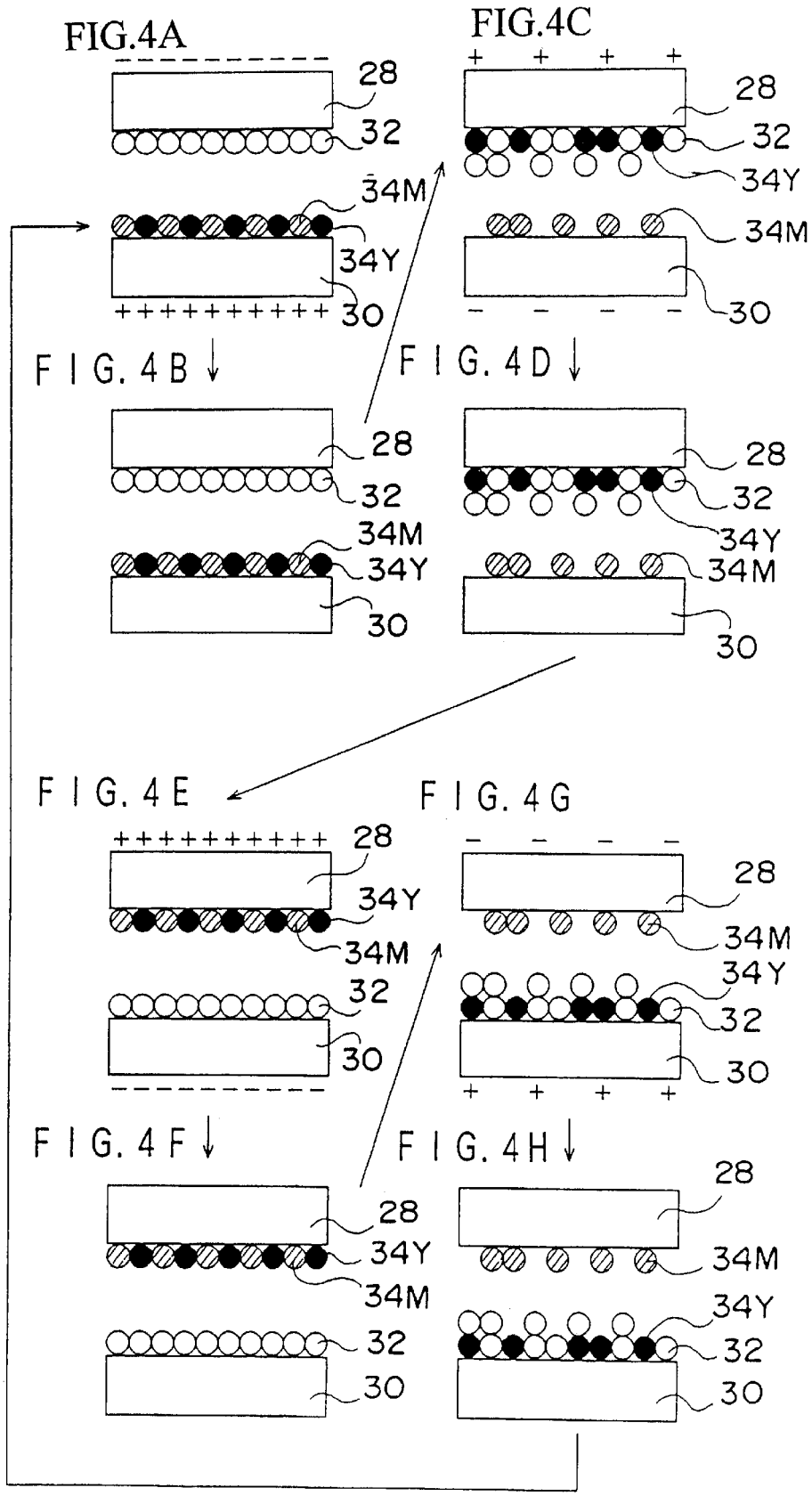
FIGS. 4A to 4H are explanatory views for explaining a relationship between a mode for applying voltage and a mode for transferring particles.

Next, when a weakly negative electric field is applied to the display surface (the side of the electrode 30) as shown in FIG. 4C, only the particles having a high charge amount are pulled away by electric attraction (Coulomb attraction), thereby overcoming adhesiveness with the substrate, and move to the opposing electrode surface (the side of the electrode 28). More specifically, in this situation, only the yellow particles 34Y move, leaving the magenta particles 34M, which do not move, but remain as they are, so that the display surface exhibits a magenta color. Thereafter, even when the electric field is set to zero, the particles do not move due to adhesiveness with the electrode, so that the above described displayed state is maintained as it stands (see FIG. 4D).

Then, if a stronger negative electric field is applied, all the particles move, whereby the displayed color is inverted and only the white particles adhere to the display surface (the side of the electrode 30) so that it displays a white color (see FIG. 4E). As in the above described case, even when the electric field is thereafter set to zero in this situation, the particles do not move due to adhesiveness with the electrode, and the white display state is maintained (see FIG. 4F).

Next, as shown in FIG. 4G, when a weakly positive electric field is applied to the display surface (the side of the electrode 30), an electric field inverse to that of FIG. 4(C) is created, so that substantially only the yellow particles 34Y shift to the display surface, whereby a yellow color is shown on the display surface. In this case, although the white particles 32 also adhere to the display surface, the display color is satisfactory so far as coloring matter in yellow particles 34y, such as a pigment, is sufficiently contained to show as yellow. In this case, the particle state is maintained also, even when the electric field is thereafter set to zero (see FIG. 4H).

Figure 5:
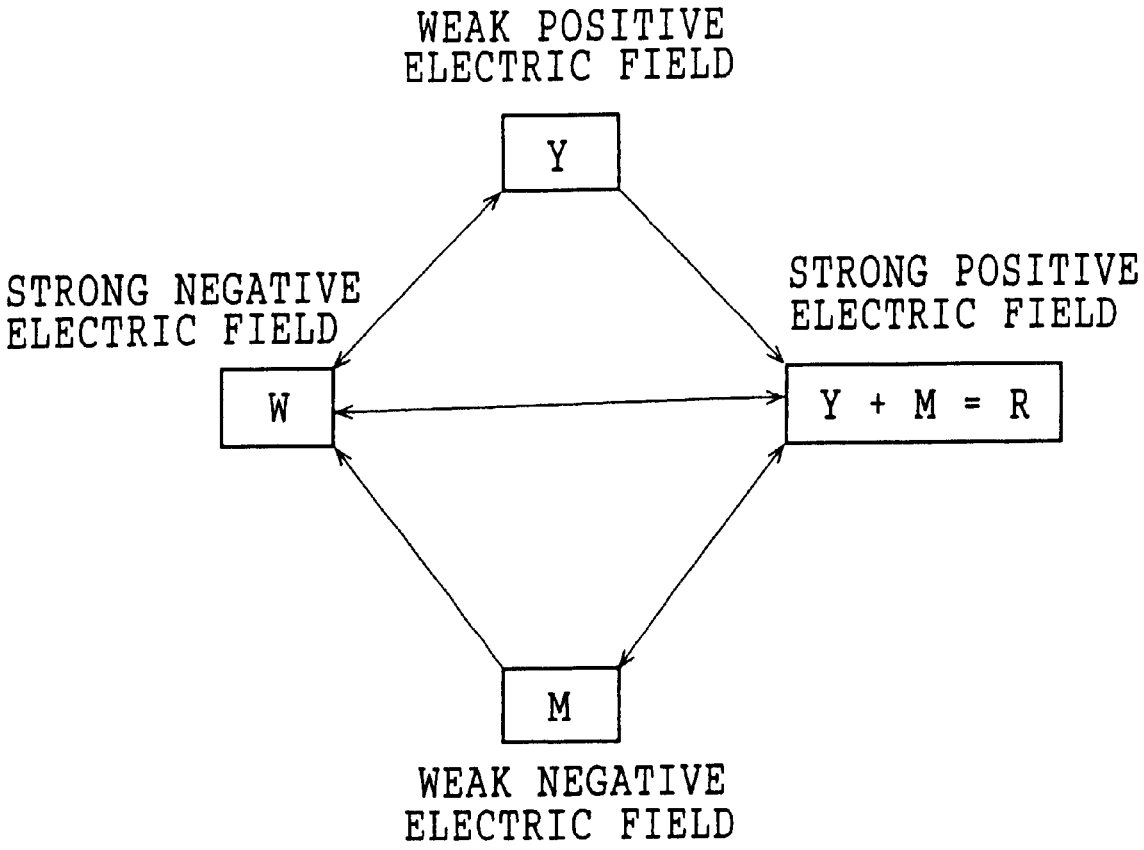
FIG. 5 is another explanatory view for explaining a relationship between a mode for applying voltage and a mode for transferring particles.

In the four states as described above, it becomes possible to display four colors (red, magenta, white, and yellow). A diagram showing relationships between connections in the above described four states and shifts due to application of an electric field are shown in FIG. 5 as a model wherein when a strongly positive electric field is applied to the electrodes 28 and 30, such that the side of the electrode 30 becomes positive, while the side of the electrode 28 is negative, a red color (R color) is displayed on the side of display surface (the side of the electrode 30). Then, when a weakly negative electric field is applied to the display surface (the side of the electrode 30), only the yellow particles 34Y, which have a higher charge amount, shift to display a magenta color (M color). Furthermore, when a stronger negative electric field is applied, all the particles shift so that the display color is inverted, and only the white particles adhere to the display surface (the side of the electrode 30) to display a white color (W color). Thereafter, when a weakly positive electric field is applied to the display surface (the side of the electrode 30), only the yellow particles 34Y shift to the display surface to display a yellow color (Y color).

Moreover, relationships were investigated between electric fields and shift of particles in the case where the above described particle groups and substrates are employed. The results obtained thereby are shown in FIG. 6.

First, a strongly negative electric field of −2.5 MV/m was applied to the display surface as a base reference, so as to initially obtain a white display for the following sequence. Specifically, an electric field is started from the reference electric field such that it is ON for 0.1 second and OFF for 0.1 second, and repeated so as to obtain a rectangular trace. Further an electric field in the ON state is allowed to change in each +0.5 MV/m, and as a result, at the time when a desired electric field is achieved, the electric field is turned OFF.

Figure 6:
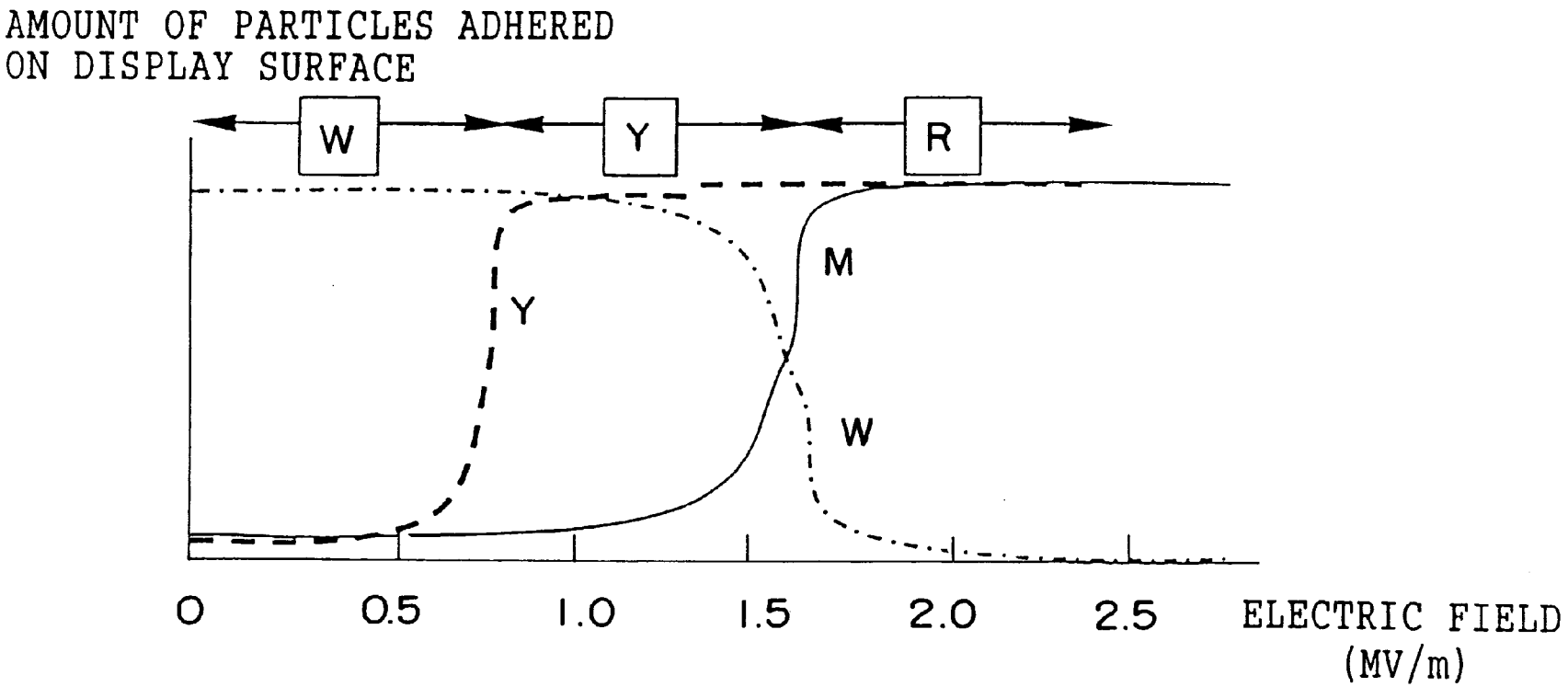
FIG. 6 is a graphical representation explaining a relationship between a mode for voltage and a mode for transferring particles.

Change transitions for the electric field, as well as changes in hue and concentration are shown in FIG. 6, were investigated by photographing the display surface with a microscope to obtain conspicuous indices, and determining amount of area that the particles covered in the photographed images. When the electric field exceeds a critical intensity of 1.0 MV/m, adhesion of yellow particles first appears. Adhesion of magenta particles first appears at 2.0 MV/m. No further changes were observed at electric field intensities greater than 2.5 MV/m.

Then, an experiment was performed such that a strongly positive electric field of +2.5 MV/m is applied for 0.1 second, and thereafter a negative electric field introduced in increments of −0.5 MV/m. When a negative electric field is applied to an initially established red (R) state, only magenta particles remain and yellow particles (Y) disappear at −1.0 MV/m, and a white display (W) state appears again at −2.0 MV/m.

As described above, switching factors are calculated for the electric field between direction, intensity and present display color, and in routing orders of commands for applying the electric field (see FIG. 5), as well as commands for applying the electric field for such a procedure that a color displayed at present is stored in the memory 20, and the color displayed at present is switched over to a desired image display color (voltage applying manner), whereby a desired color can be rapidly displayed.

Figure 7:
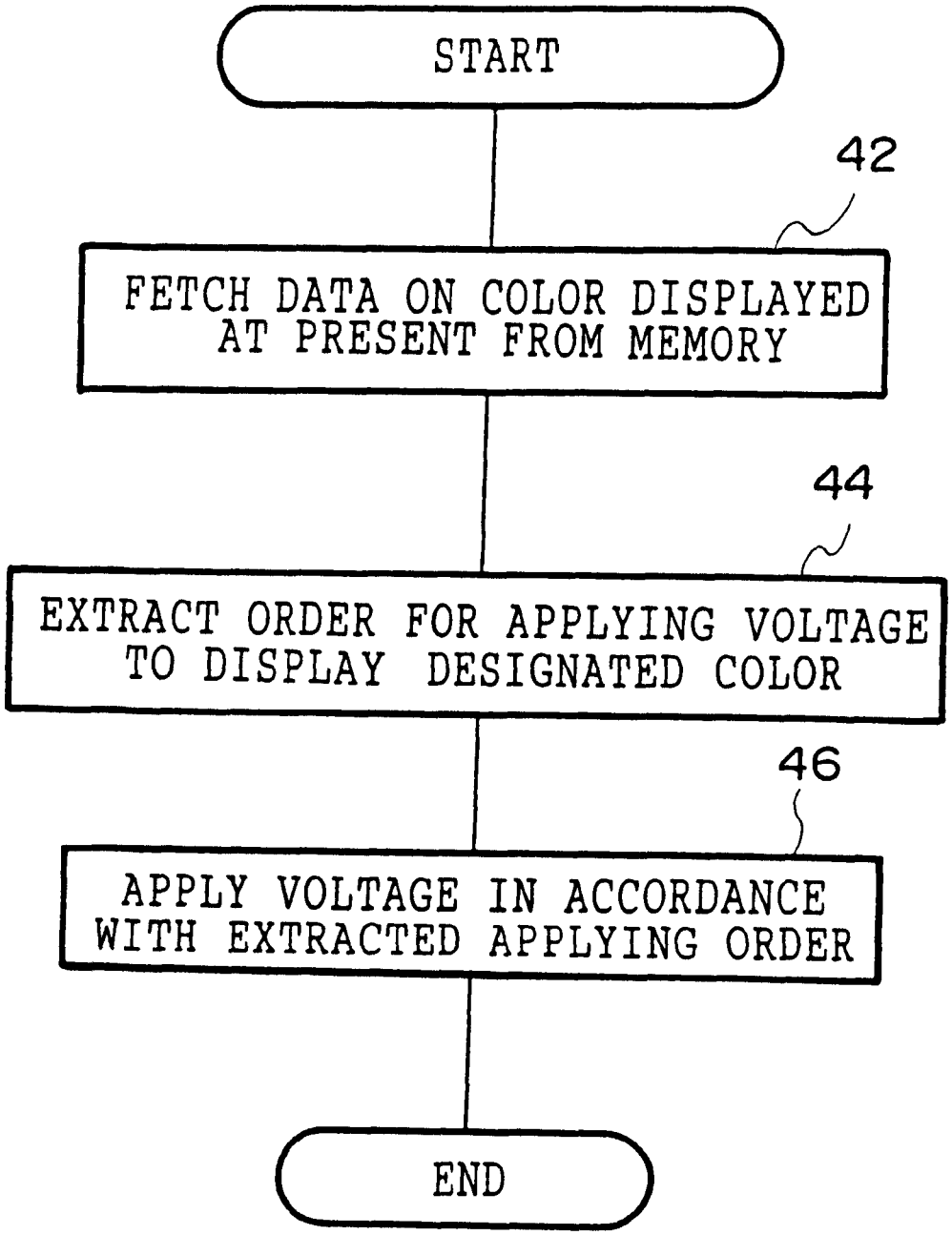
FIG. 7 is a flowchart showing an image display processing routine.

More specifically, since a color displayed at present has been stored in the memory 20 as mentioned above, the color displayed at present is retrieved in a step 42, and a command for applying an electric field is extracted to display a designated color based on the above described switching factors (type of the electric field, color, and routing order of command for applying the electric field shown in FIG. 5), the color displayed at present, and the designated color in a step 44 as shown in FIG. 7. In a step 46, voltage is applied in accordance with the extracted order of application. In this case, the designated color at this time is stored in the memory as a presently displayed color.

Figure 8:
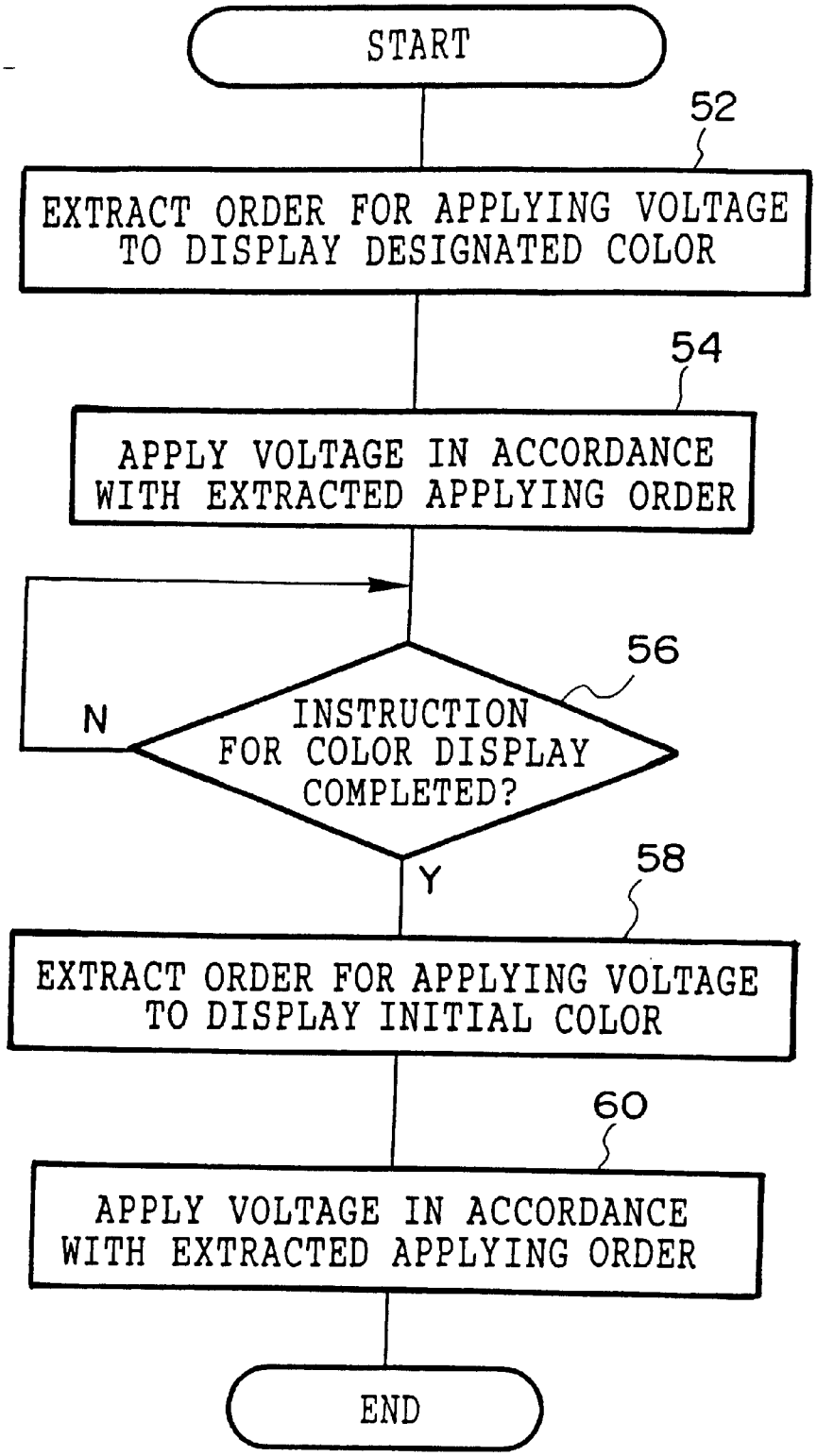
FIG. 8 is a flowchart showing another image display processing routine.

Different from the above described control, the following procedure is also applicable. Namely, an electric field is applied in response to an image after having been initialized by applying the electric field, which has been previously unified. As a result, there is no necessity for utilizing a sequence for driving the electric field that is dependent upon a color displayed at present as described above. Instead, operation can be carried out in response to the color of an image in accordance with a unitary sequence. More specifically, as shown in FIG. 8, initialization is always conducted in the case where there is no need for controlling operation of the electric field as mentioned hereinafter. In other words, the display surface is set to an initial color which has been previously determined (for example, white, but it is to be noted that it is not limited to white), whereby a command for applying the electric field for displaying a designated color following the present state (white display color) is decided unitarily. In step 52, a command for applying voltage for displaying a color which was designated on the basis of the initial color decided unitarily is extracted, and a voltage is applied in accordance with the command for application extracted in a step 54. In a step 56, it is determined whether or not an instruction for color display was completed. In case of completion of the instruction for color display, a command for applying voltage to display the initial color (a command reverse to that extracted in the step 52) is extracted in step 58, and a voltage is applied in accordance with the command for application extracted in a step 60. As a result, a display surface can be always kept at the initial color. In the meantime, when the Y color or M color is selected as an initial color for the above described case, processes for going through these two colors may be omitted.

In the present embodiment, an alternating electric field is applied to prevent deformation resulting from particles colliding with the substrate in respective stages, wherein the particles are transferred. In an initial stage of applying the electric field, a comparatively high voltage is applied so as to produce an electric field necessary for pulling particles away from the substrate. However, when such high voltage is continually applied, particles collide with the opposing substrate at high speed, resulting in deformation or similar difficulties. Accordingly, in next step, a voltage is applied in a reverse direction in the following stage for producing an electric field of the reverse direction decrease the particle speeds. Thus, the speed of particles directed to the opposing substrate is reduced, so that they shift in the reverse direction. In this situation, however, when the particles continue to shift in the reverse direction, these particles cannot reach the opposing electrode. Accordingly, the electric field is applied again in the other direction. In this regard, a collision speed can be previously determined at which level particles do not deform from colliding with the opposing substrate. In the present embodiment, a voltage waveform is determined as shown in FIG. 9 such that particles collide with the opposing substrate at a collision speed less than at a level, which will cause particle deformation as a result of collision with the opposing substrate, and a voltage is to be applied in accordance with the resulting waveform.

Figure 9:
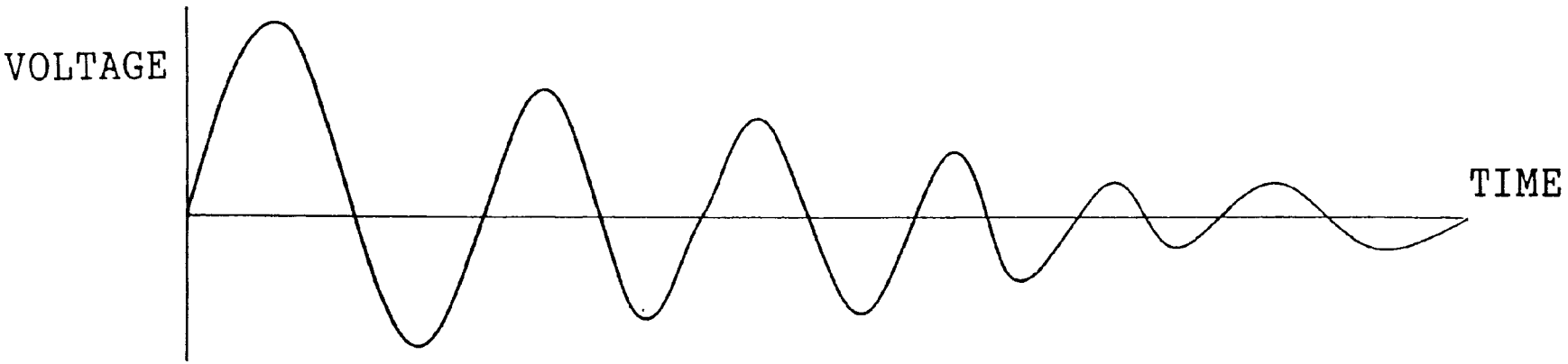
FIG. 9 is a diagram showing an alternating voltage waveform.

As in the voltage waveform shown in FIG. 9, when an amplitude of the alternating electric filed is reduced by gradually decreasing momentum in shifting of particles, whereby adhesiveness with a wall surface can be reduced. In other words, when a strong electric field is applied to particles which have adhered with low adhesiveness, there arises a strong driving force, so that particles shift at high speed, and collide strongly with the opposing surface. This results in more increased adhesiveness. Therefore, when the speed of particle transfer is limited, adhesiveness with a wall surface can be reduced.

It is to be noted that an image display unit necessary for preventing deformation of particles as a result of particle collisions with a substrate, is not limited to the present first embodiment. In this respect, the following image display unit is proposed. Namely, it is an image display unit provided with an image display medium for containing charged particles in a space defined between a pair of opposed substrates, such that the particles are transferred in response to an applied electric field to form an image, and an electric field applying means for applying the electric field to the particles for forming an image by transferring the particles to the substrate, characterized by that the electric field applying means applies the electric field in such a manner that particles collide with the substrate at a collision speed predetermined to be less a level at which causes particle deformation from collisions with the opposing substrate.

In this case, it may be arranged in such that the electric field applying means contained in the above described image display unit applies a strong electric field required for pulling particles away from the substrate during an initial period, wherein the particles are to be pulled away from the substrate.

The above described alternating voltage is not only used for preventing deformation of particles in association with collision of the particles with a substrate, but also for, e.g., allowing transfer reciprocatively of the particles in frictional contact with other particles, thereby maintaining a charge amount.

Furthermore, it may be arranged in such that average surface roughness per a particle is allowed to differ from each other in the above described plurality of types of particle groups.

In the following, a second preferred embodiment according to the present invention will be described, wherein a component of the second embodiment is the same as that of the above-mentioned first embodiment, so that an explanation therefor is omitted.

In the second embodiment, the aforementioned white particles 32 and the yellow particles 32Y are employed, while commercially available color toner is used as magenta particles 34M. In the present embodiment, the color toner is a toner for A-COLOR935, which is a negatively charged toner, and having an average particle diameter of 7μm, and a shape of the particles being amorphous (incomplete sphere).

A charge state in case of mixing three types of particles according to the second embodiment are as follows. Namely, the yellow particles 34Y are each negatively charged and spherical, the magenta particles 34M are each negatively charged and amorphous in shape (incomplete sphere), and the white particles are each positively charged and spherical. As described above, since the yellow particles 34Y are spherical and the magenta particles 34M are amorphous in shape (incomplete sphere), the yellow particles 34Y differ from the magenta particles 34M in degree of sphericity relative each other.

The particles 34Y differ from the particles 34M in particle diameter. Since the number of particles in the case of uniform adhesive on the display surface is inversely proportional to the square of particle diameter, a ratio of the particles 34Y and 34M is 400:49, this corresponds to a relationship of about 8:1 in the second embodiment. For making a charged amount of the whole particle groups to be uniform, it is adjusted in such a manner that the yellow particles. 32Y are in $-16\times10^{-15}$C and the magenta particles 34M are in $-2\times10^{-15}$C in such that an average charge amount per particle is approximately to be 8:1. Then, the particles thus prepared with the foregoing charges are enclosed together with air in a space defined between opposing substrates.

In the second embodiment, four colors can be displayed (FIGS. 4A to 6) as in the aforementioned first embodiment. In this mixture of particles, even if a total charge amount of the magenta and the yellow particles is uniform, display of four colors can be achieved as in the first embodiment, because adhesiveness is different between particles, as well as between particles and substrates. In other words, there is no requirement for a particular particle shape, and commercially available chargeable image forming particles may be used, whereby a medium can be prepared, which is capable of display four colors.

Next, a third preferred embodiment of the present invention will be described, wherein components thereof are the same as that of the above-mentioned first embodiment, so that the same components are designated by the same reference numerals in the first embodiment and an explanation therefor will be omitted. Accordingly, only different components from those of the first embodiment will be described.

Figure 10:
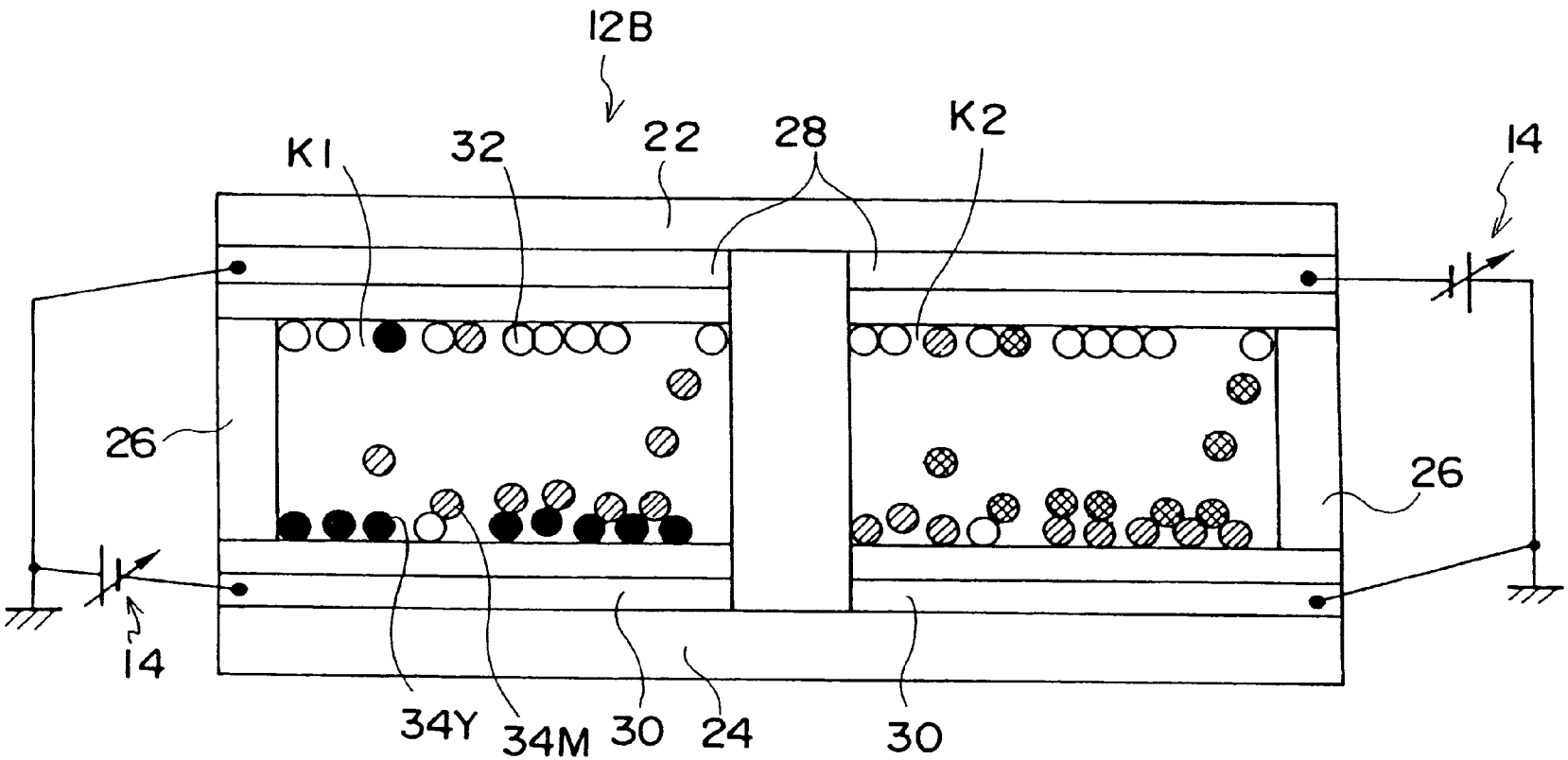
FIG. 10 is a schematic diagram showing another preferred embodiment of an image display unit according to the present invention.

In the above-mentioned first embodiment, a single space is defined between a pair of substrates, while an image display unit according to the third embodiment defines similar space containing a plurality of smaller spaces or sections (two space sections or parts for image display in the third embodiment) as shown in FIG. 10.

In the first section space K1, are enclosed a particle group of yellow color and a particle group of magenta color, each having the same charge polarity (negative) and different adhesiveness, together with a particle group of white color having different polarity (positive) from those of the above particle groups.

In another section space part K2, is enclosed at least one particle group (a white color particle group and a cyan color particle group in the third embodiment) having a different color from those of the particles enclosed in the first section space K1.

As shown in FIG. 10, electrodes 28 and 30 are disposed in response to the first section space K1 and the second section space K2, respectively. In FIG. 10, although only amplifiers 14 are shown, a power source and a controller are further connected to the respective amplifiers 14 as well as to the electrodes 28 and 30 in the respective section spaces in the third preferred embodiment.

In the present third embodiment, the respective particles are allowed to be selectively transferred as described above to effect color display on a display surface as follows.

As mentioned above, since the yellow color particle group, the magenta color particle group, and the white color particle group are enclosed in the first section space K1, four colors of red, magenta, white, and yellow can be displayed as explained in the first embodiment. While in the second section space K2, since the white color particle group and the cyan color particles are enclosed, two colors of white and cyan can be displayed. In each of the cases where red, magenta, white or yellow is displayed in the first section space K1, when white or cyan is displayed in the second section space K2, any of the colors shown in Table 1 is displayed as a whole.

TABLE 1

| | Second Section Space | |
|---|---|---|
| First Section Space | White | Cyan |
| Red | Red | Black |
| Magenta | Magenta | Blue |
| White | White | Cyan |
| Yellow | Yellow | Green |

As described above, in the third embodiment, red, magenta, white, and yellow can be selectively displayed in the first section space K1, besides eight colors (full color display) of red, magenta, white, yellow, black, blue, cyan, and green can be selectively displayed in the second section space K2.

In the following, a fourth preferred embodiment of the present invention will be described wherein an image display controller of the present embodiment is provided with a mounting assembly 70 for mounting any one of image display media relating to the above-mentioned first to third embodiments, for example, the image display medium 12C relating to the aforementioned third embodiment in the present embodiment, and an electric field generator 15C for applying an electric field having intensity corresponding to plural types of particle groups contained in the image display medium 12C mounted on the mounting assembly 70, for particle group transferrence.

Figure 12:
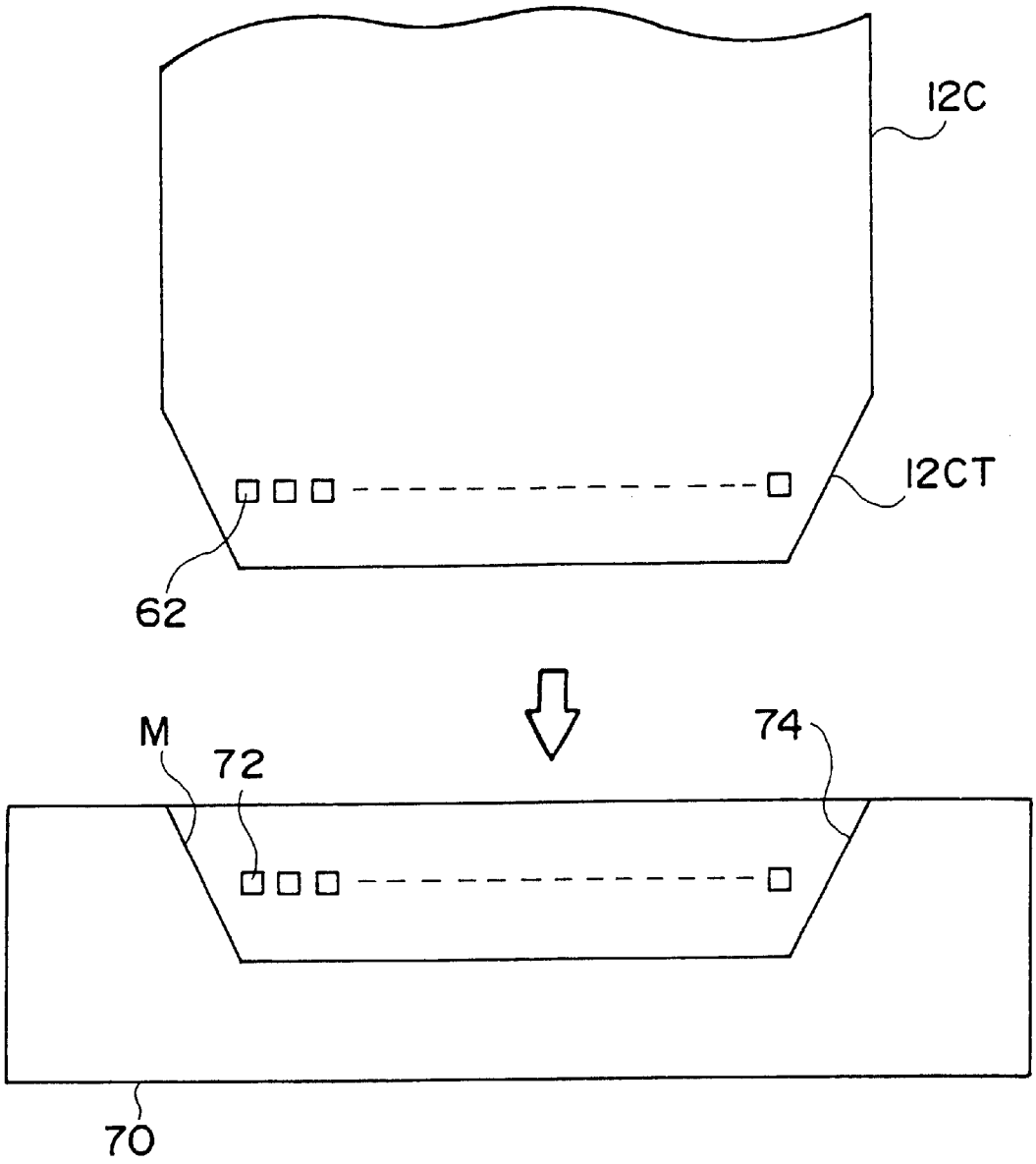
FIG. 12 is a schematic view showing a relationship between an image display medium and a mounting assembly.

In the image display medium 12C, the above described space defined between the substrates 22 and 24 contains a plurality of section spaces as mentioned above, and electrodes 28 and 30 are disposed with respect to the section spaces, respectively. Furthermore, as shown in FIG. 12, a plurality of connectors 62 connected to electrodes, which are placed in response to the respective section spaces are disposed on a substrate at one end of the image display medium 12C. A positioning tapered portion 12CT is defined on the image display medium 12C at the end, where a plurality of the connectors 62 are placed.

A concave side M is defined on the mounting assembly 70 such that the image display medium 12C can be inserted thereinto as shown in FIG. 12, wherein a contour of the concave side M is defined such that the one side of the image display medium 12C where a plurality of the connectors 62 are placed, is fit therein. More specifically, a positioning tapered portion 74 corresponding to the tapered portion 12CT in the image display medium 12C defines the concave side M. Moreover, connectors 72 which are connected to the above described connectors 62 in the case when the image display medium 12C is inserted into the concave side M, are placed on a side of the concave side M, wherein a computer 18C is connected to the connectors 72.

Figure 11:
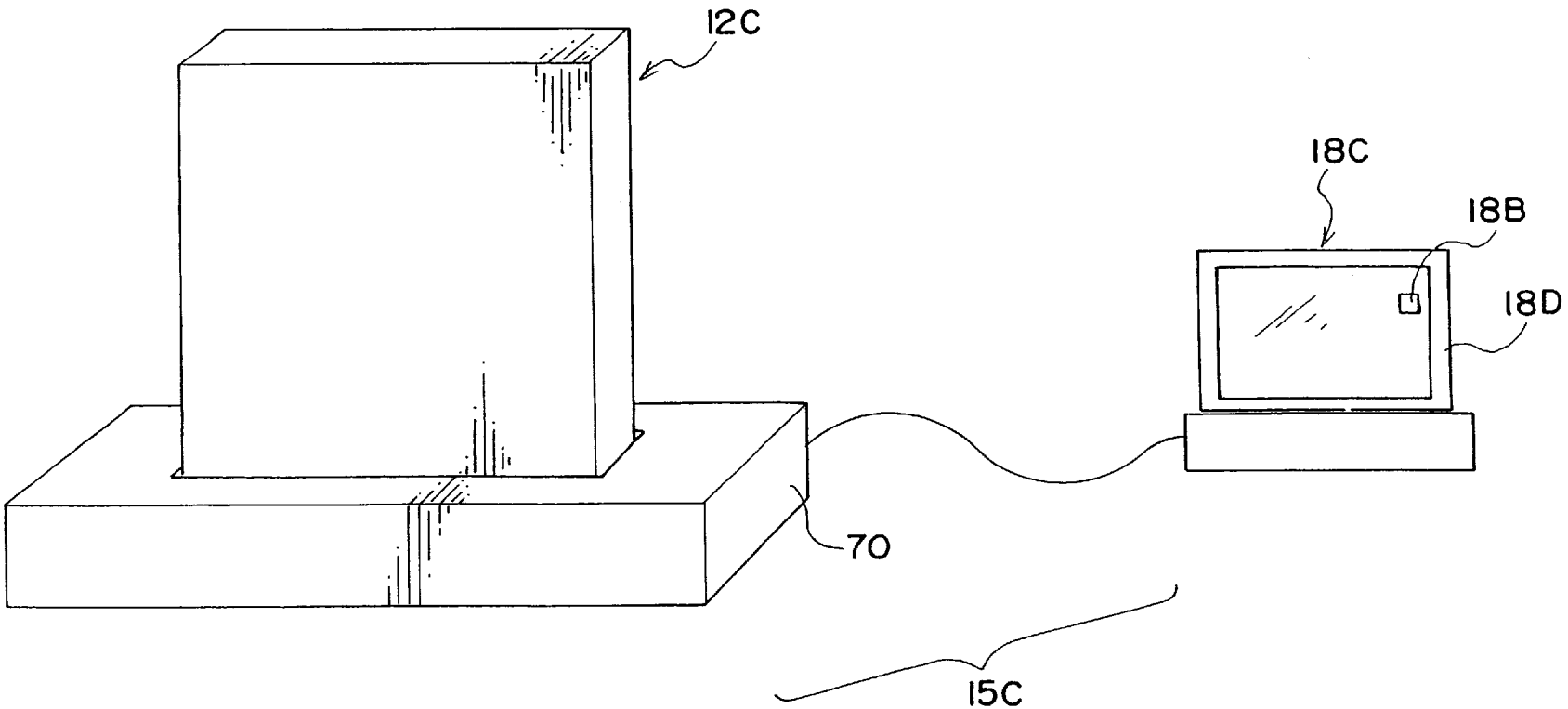
FIG. 11 is a schematic view showing another preferred embodiment of an image display controller according to the present invention.

Rewriting of an image is adapted for instruction via a user interface (UI) displayed on a display 18D of the computer 18C. More specifically, a user mounts the image display medium 12C on the mounting assembly 70 as shown in FIG. 11, and an image is selected by means of the computer 18C. Then, when a starting button is clicked for rewriting 18B on the UI (not shown), an image signal is output to apply a voltage to the electrodes 28 and 30 in the respective section spaces through the connectors 72 as well as 62, whereby an electric field is applied, so that a color image is displayed on the basis of the same principle as that mentioned above.

Since the image display medium 12C maintains memory functions under no electric field, it is possible that a user can remove the image display medium from the connectors after an image is once displayed, and transport the image display medium to another direction.

In the above described embodiments, while the connectors have been directly connected to the electrodes, both or either of the electrodes may be placed outside the substrates so far as an electric field is applied to particle groups in a cell. As a result, an electric field can be applied to the particles from outside of the image display medium 12C.

According to the present invention, it is possible that an exterior image signal source such as computer or network such as Internet is connected to any of the image display units or the image display controllers in the aforementioned embodiments, and an electric field applied in response to an input signal supplied. In this case, a form of connection with such exterior signal source may be either wire or wireless connection wherein radio receiving equipment is provided on the side of image display controller. Furthermore, image information which can be displayed in the present invention is not only still images, but also moving images, as a matter of course. Moreover, an electric field generating device may be freely laid out such that the device is placed on a reverse or other side of an image display medium.

As described above, according to the present invention, since transfer of a plurality of particle groups enclosed in a gas or vacuum, having different colors from one another, having the same polarity, making adhesiveness with respect to substrates different from one another can be selectively and precisely controlled by adjusting intensity of an electric field, there are advantages that a plurality of colors are selectively developed by means of the particle groups enclosed in the space defined between a pair of substrates, for achieving appearance of a color display image.

What is claimed is:

1. An image display medium, comprising:

a pair of substrates, at least one of which is substantially transparent, and space defined between them, with some gas disposed in the space; and a plurality of types of particle groups enclosed in said space defined between said pair of said substrates, each particle type having a charge of a polarity identical in polarity to all of the other types of particle groups, and the types of particle groups having an adhesiveness with respect to said substrates different from one another.

2. The image display medium according to claim 1, wherein said types of particle groups have colors different from one another.

3. The image display medium according to claim 1, wherein each of said types of particle groups has a different average charge amount per particle from that of another of said types of particle groups.

4. The image display medium according to claim 1, wherein each of said types of particle groups has a different average diameter of particles from that of another of said types of particle groups.

5. The image display medium according to claim 1, wherein each of said types of particle groups has a different average degree of sphericity per particle from that of another of said types of particle groups.

6. The image display medium according to claim 1, wherein each of said types of particle groups has a different average degree of surface roughness per particle from that of another of said types of particle groups.

7. The image display medium according to claim 1, wherein adhesiveness of at least one particle group of said types of particle groups, has a distribution breadth.

8. The image display medium according to claim 1, wherein at least one particle group having a charge of a different polarity from that of said types of particle groups, is enclosed in said space.

9. The image display medium according to claim 1, wherein at least one particle group having a charge of a different polarity from that of said types of particle groups is enclosed in said space, and said at least one particle group having the different polarity, exhibits a white color.

10. The image display medium according to claim 1, wherein said space contains a first section enclosing said types of particle groups, and a second section adjacent to said first section and enclosing at least one particle group having a different color from that of said plurality of types of particle groups.

11. An image display device, comprising:

a pair of substrates, at least one of which is substantially transparent, and space defined between them, with some gas disposed in the space;

a plurality of types of particle groups enclosed in said space defined between said pair of said substrates, each particle type having a charge of a polarity identical in polarity to all of the other types of particle groups, and the types of particle groups having an adhesiveness with respect to said substrates different from one another; and an electric field generator connected to the substrates for applying an electric field having an intensity according to the average charge amount of a type of particle group for transferring that type of particle group to one of the substrates for displaying a particular color.

12. The image display device according to claim 11, wherein said electric field generator applies an electric field of another intensity for displaying another color.

13. The image display device according to claim 11, further comprising:

a memory for storing a present display color formed by at least one particle group transferred to one of the substrates; and a controller connected to the memory and connected to and controlling said electric field generator, with logic that determines a manner for applying an electric field for displaying a following display color on the basis of the present display color stored in said memory as well as the following color, and applies the electric field in accordance with the manner determined by controlling the electric field generator.

14. The image display device according to claim 11, wherein said electric field generator applies an alternating electric field having an amplitude that varies with time.

15. An image display device, comprising:

a pair of substrates defining a space between one another, at least one of which is substantially transparent, some gas disposed in the space between the substrates;

a display medium including a plurality of types of particle groups enclosed in the space between the substrates so as to be movable between the substrates by applying an electric field, the particle groups having different colors and charge properties;

an electric field generator which generates an electric field corresponding to an image between the pair of substrates; and a mounting assembly which detachably mounts the display medium and the electric field generator to each other.

16. The image display device according to claim 15, further comprising a pair of electrodes provided for applying the electric field to the space, and at least one of the electrodes is not formed on the substrate.

17. The image display device according to claim 16, wherein at least one of the pair of electrodes is formed on the display medium, and the electric field generator has terminals connected to the electrodes to supply an electric signal.

18. A method for electronically displaying an image, using a pair of substrates, at least one of which is substantially transparent, and space defined between them, with some gas disposed in the space and a plurality of types of particle groups enclosed in said space defined between said pair of said substrates, each particle type having a charge of a polarity identical in polarity to all of the other types of particle groups, and the types of particle groups having an adhesiveness with respect to said substrates different from one another, the method comprising:

(a) forming a display panel from a plurality of sections in a matrix arrangement, by enclosing each section between a pair of substrates, one substrate of which light substantially passes therethrough in visible wavelengths;

(b) disposing in each section particles of different colors, with each particle of a color having a charge of a polarity identical and an average electric charge different from particles of other colors; and (c) applying an electric field in accordance with an image to the sections of the matrix to display the image by electrically adhering particles of selected colors to one of the substrates.

19. A method according to claim 18, wherein disposing in each section particles of different colors, includes using at least one type of particles having a polarity opposite to that of the other particles.

* * * * *